US008157565B2

(12) United States Patent
Jones et al.

(10) Patent No.: US 8,157,565 B2
(45) Date of Patent: Apr. 17, 2012

(54) MILITARY TRAINING DEVICE

(75) Inventors: Giles D. Jones, Vail, AZ (US); Bradley Huang, Chino Hills, CA (US); Qingce Bian, Corona, CA (US); Christopher A. Tomlinson, Vail, AZ (US); Peter M. Wallrich, San Jose, CA (US); William W. Price, Upland, CA (US); Jeffrey E. Decker, Moreno Valley, CA (US); Eric R. Davis, Orlando, FL (US)

(73) Assignee: Raytheon Company, Waltham, MA (US)

( * ) Notice: Subject to any disclaimer, the term of this patent is extended or adjusted under 35 U.S.C. 154(b) by 1112 days.

(21) Appl. No.: 12/024,775

(22) Filed: Feb. 1, 2008

(65) Prior Publication Data

US 2009/0053679 A1 Feb. 26, 2009

Related U.S. Application Data

(60) Provisional application No. 60/898,805, filed on Feb. 1, 2007.

(51) Int. Cl.
*F41G 3/26* (2006.01)

(52) U.S. Cl. ..... 434/21; 434/11

(58) Field of Classification Search ..... 434/11–27; 250/227.1, 551; 463/51, 39, 49, 53, 56; 340/573.1, 340/825.57, 568.1, 539.21
See application file for complete search history.

(56) References Cited

U.S. PATENT DOCUMENTS

| | | | | |
|---|---|---|---|---|
| 4,487,583 | A | 12/1984 | Brucker et al. | 434/22 |
| 4,712,885 | A | 12/1987 | Dawson et al. | |
| 4,899,039 | A * | 2/1990 | Taylor et al. | 250/208.2 |
| 5,074,793 | A | 12/1991 | Hambric et al. | |
| 5,476,385 | A | 12/1995 | Parikh et al. | |
| 5,481,979 | A | 1/1996 | Walder | |
| 5,914,661 | A | 6/1999 | Gross | |
| 6,065,404 | A | 5/2000 | Ripingill, Jr. et al. | 102/498 |
| 6,579,097 | B1 | 6/2003 | Sampson et al. | 434/21 |
| 6,798,391 | B2 | 9/2004 | Peterson, III | |
| 6,899,539 | B1 | 5/2005 | Stallman et al. | |
| 7,132,635 | B2 | 11/2006 | Dowling | |
| 7,387,073 | B2 | 6/2008 | Bodley et al. | |
| 2005/0153262 | A1 * | 7/2005 | Kendir | 434/21 |

OTHER PUBLICATIONS

PCT Notification of Transmittal of the International Search Report and the Written Opinion of the International Searching Authority, or the Declaration for International Application No. PCT/US2008/052793, 12 pages, Sep. 18, 2008.

* cited by examiner

*Primary Examiner* — Xuan Thai
*Assistant Examiner* — Timothy A Musselman
(74) *Attorney, Agent, or Firm* — Renner, Otto, Boisselle & Sklar, LLP

(57) ABSTRACT

According to one embodiment, a military training device includes a multiple integrated laser engagement system (MILES) device configured in a piece of apparel. The multiple integrated laser engagement system device includes a light transducing element coupled to an electrical circuit. The light transducing element transmits or receives multiple integrated laser engagement system compliant signals. The light transducing element is attached to an outer surface of the apparel and oriented so that a radiation pattern of the multiple integrated laser engagement system compliant signals is generated outwardly from the apparel during use.

20 Claims, 3 Drawing Sheets

MILITARY TRAINING DEVICE

RELATED APPLICATIONS

This application claims priority to U.S. Provisional Patent Application Ser. No. 60/898,805, entitled "MILITARY TRAINING APPAREL FOR A MULTIPLE INTEGRATED LASER ENGAGEMENT SYSTEM," which was filed on Feb. 1, 2007, and which is incorporated herein by reference.

GOVERNMENT RIGHTS

This invention was made with Government support under N61339-00-D-001, awarded by the Naval Air Warfare Center. The Government has certain rights in this invention.

TECHNICAL FIELD OF THE DISCLOSURE

This disclosure generally relates to training devices, and more particularly, to a military training device integrally formed in a piece of apparel and a method of operating the same.

BACKGROUND OF THE DISCLOSURE

Training is an important aspect of almost any useful endeavor. The act of training generally enhances the skill of individuals by repetition and developing appropriate responses to various situations that may be encountered. Soldiers may conduct various types of training exercises in order to prepare for various scenarios that may be anticipated in an actual combat situation.

The multiple integrated laser engagement system (MILES) has been developed in order to provide a realistic training battlefield environment for soldiers. The multiple integrated laser engagement system includes simulated offensive weapons, such as firearms, that emit relatively harmless line-of-sight signals generated by one or more light emitting diodes (LED) or lasers.

SUMMARY OF THE DISCLOSURE

According to one embodiment, a military training device includes a multiple integrated laser engagement system (MILES) device configured in a piece of apparel. The multiple integrated laser engagement system device includes a light transducing element coupled to an electrical circuit. The light transducing element transmits or receives multiple integrated laser engagement system compliant signals. The light transducing element is attached to an outer surface of the apparel and oriented so that a radiation pattern of the multiple integrated laser engagement system compliant signals is generated outwardly from the apparel during use.

Particular embodiments of the present disclosure may exhibit some, none, or all of the following technical advantages. For example, an advantage of one embodiment may include relatively more realistic training scenarios for military exercises. The miles device may be incorporated into any culturally and ethnically appropriate clothing that may be used by, for example, a terrorist. Trainees, therefore, may be encouraged to identify potential terrorists by their behavior or other characteristic actions, rather than by identifying cumbersome military training gear, such as harnesses, which may be easily detected.

Other technical advantages will be readily apparent to one skilled in the art from the following figures, description, and claims.

BRIEF DESCRIPTION OF THE DRAWINGS

A more complete understanding of embodiments of the disclosure will be apparent from the detailed description taken in conjunction with the accompanying drawings in which.

DETAILED DESCRIPTION OF EXAMPLE EMBODIMENTS

The teachings of the present disclosure recognize that apparel used in known multiple integrated laser engagement systems may not adequately simulate the appearance of an enemy combatant. Enemy combatants such as terrorists for example, may purposefully wear apparel that is culturally appropriate for the location in which they attack. These terrorists may do this in order to reduce the possibility of recognition while mingling among locally indigenous people. These known multiple integrated laser engagement systems, therefore, may not properly train military personnel in various tactics of enemy combatant recognition.

Figure 1:
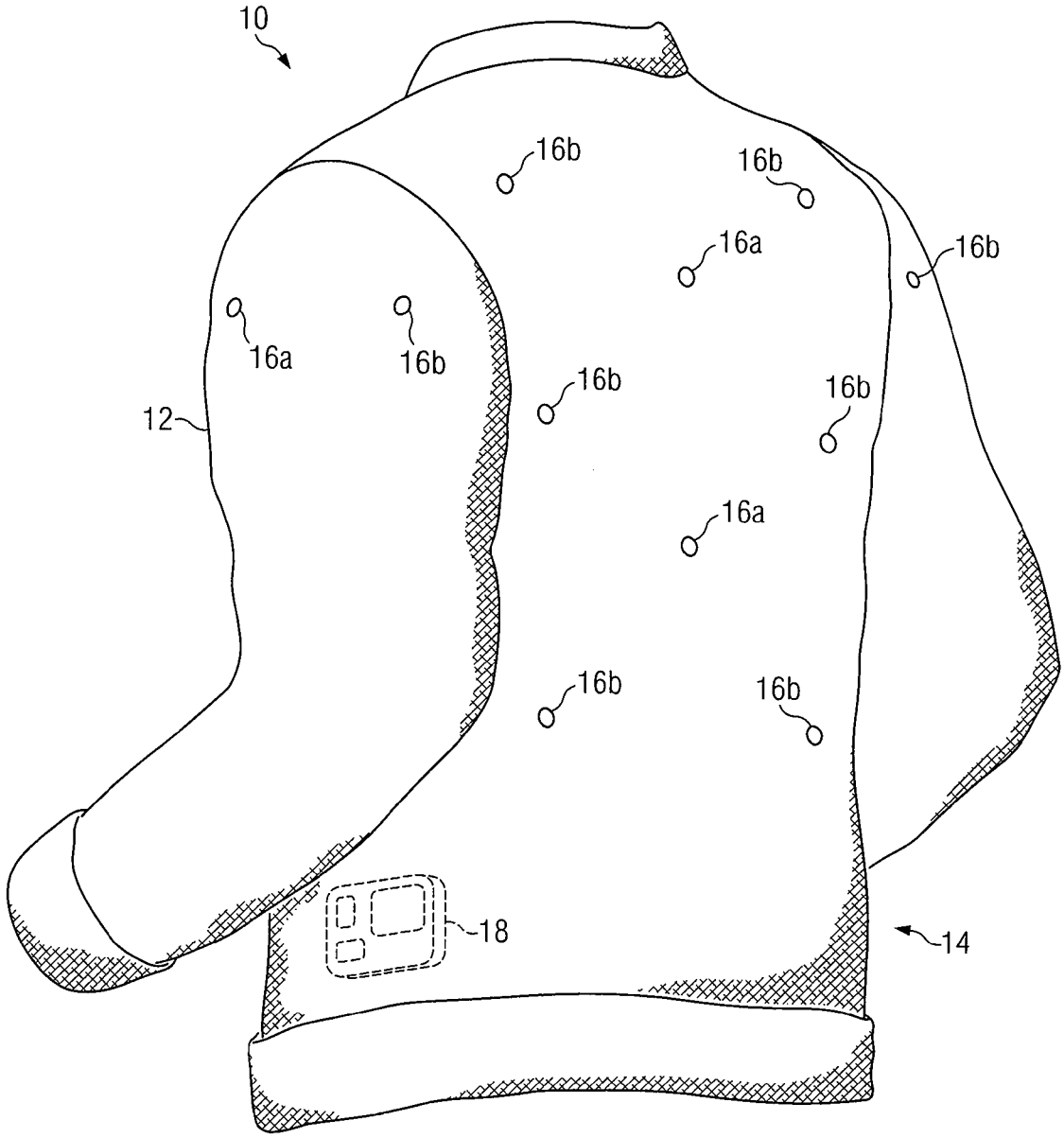
FIG. 1 is a perspective view of one embodiment of a military training device according to the teachings of the present disclosure.

FIG. 1 shows one embodiment of a military training device 10 that may alleviate the previously described drawbacks of known multiple integrated laser engagement systems. The military training device 10 generally includes a piece of apparel 12 that is configured with a multiple integrated laser engagement system device 14 having one or more light transducing elements 16 and an electrical circuit 18. Light transducing elements 16 may include light generating devices 16*a*, light detectors 16*b*, or a combination of light generating devices 16*a* and light detectors 16*b*. Light transducing elements 16 are attached to apparel 12 and oriented so that a radiating pattern generated by light transducing elements 16 are directed outwardly from apparel 12.

Light generating devices 16*a* generate multiple integrated laser engagement system compliant light signals. Multiple integrated laser engagement system device 14 configured with light generating devices 16*a* may simulate an offensive weapon, such as a bomb. Light detectors 16*b* receive multiple integrated laser engagement system compliant light signals generated by another multiple integrated laser engagement system device. For example, multiple integrated laser engagement system device 14 configured with light detectors 16*b* may simulate an attack on various portions of the trainee's body.

Integration of light transducing elements 16 into a piece of apparel 12 may provide enhanced training in some embodiments. For example, military training device 10 may train soldiers to identify enemy combatants based upon their clothing rather than known multiple integrated laser engagement system devices configured on harnesses, which may be easily seen. In certain embodiments, military training device 10 may be concealed in apparel 12 to encourage identification of enemy combatants based on their behavior or other mannerisms characteristic of enemy combatants.

Light generating devices 16 may be light emitting diodes (LEDs) or lasers that simulates activation of an offensive weapon. For example, multiple light generating devices 16*a* may simulate an explosive blast, such as from a terrorist detonating a self-exterminating bomb. When actuated, light generating devices 16*a* may transmit a number of multiple integrated laser engagement system compliant signals towards other multiple integrated laser engagement system aware devices. The light generating devices 16*a* may be configured at varying orientations on apparel 12 such that a relatively wide radiation pattern is generated around apparel 12 during activation. In one embodiment, light generating devices 16*a* may be configured to transmit multiple integrated laser engagement system compliant signals with a luminous intensity and a radiation pattern that simulates a bomb blast generated by a bomb, such as an improvised explosive device (IED).

Light detectors 16 may receive multiple integrated laser engagement system compliant signals, such as signals indicative of an impact by another multiple integrated laser engagement system device transmitting multiple integrated laser engagement system compliant signals. Multiple light detectors 16*b* may be configured at varying orientations on apparel 12 to receive simulated attacks on various portions of the trainee's body.

Figure 2A:
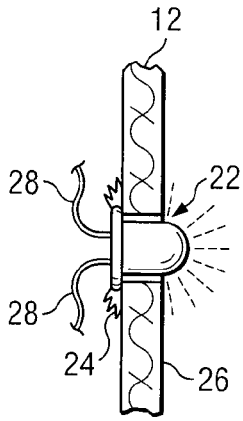
FIG. 2A is an enlarged cross-sectional view of embodiment of the military training device of FIG. 1 showing one embodiment of an approach for attaching the light transducing element to the apparel.

FIG. 2A is an enlarged cross-sectional view of a portion of military training device 10 showing one embodiment of a light transducing element 16 attached to apparel 12. Light transducing element 16 may be attached to apparel 12 using any suitable approach. In the particular embodiment shown, light transducing element 16 extends through a hole 22 in apparel and is securely attached using an adhesive 24, such as room temperature vulcanizing (RTV) glue. Thus, light transducing element 16 may transmit or receive miles signals outwardly from the outer surface 26 of apparel 12 while its electrical wires 28 are concealed from view.

Figure 2B:
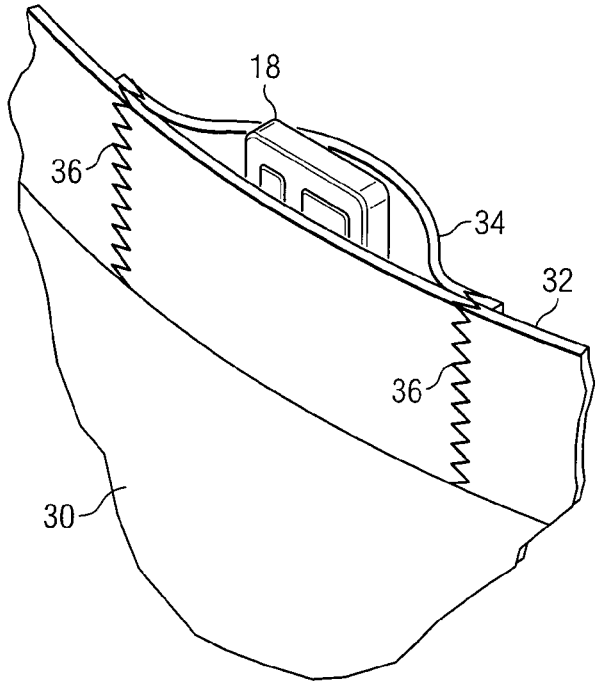
FIG. 2B is a cross-sectional view of the military training device of FIG. 1 showing one embodiment of an approach for attaching the electrical circuit to the apparel.

FIG. 2B is cross-sectional perspective view of apparel 12 showing one embodiment of an attachment approach of electrical circuit 18 to apparel 12. In this particular embodiment, apparel 12 has an outer layer 30, an inner lining 32, and a pouch 34 configured as shown. Pouch 34 is attached to inner lining 32 using one or more stitching seams 36. Electrical circuit 18 is entrapped in pouch 34 between stitching seams 36. In other embodiments, pouch 34 may be attached to inner lining 32 using an adhesive as described above. In this particular embodiment, apparel 12 has one inner lining 32. In other embodiments, apparel 12 may have any number of inner linings 32. For example, apparel 12 may have no inner linings 32 in which pouch 34 is attached directly to outer layer 30.

Electrical circuit 18 may be attached to apparel 12 using any suitable approach. In another embodiment, electrical circuit 18 is attached to apparel 12 through a cord having wires that convey electrical signals to light transducing elements 16. In this manner, electrical circuit 18 may be carried in the trainee's pocket or other convenient location, such as on his or her belt using a belt clip.

In the particular embodiment shown, apparel 12 is a jacket. Apparel 12, however, may be any suitable type of apparel made of cloth, leather, or the like, that is used to cover a portion of the human body.

Figure 3:
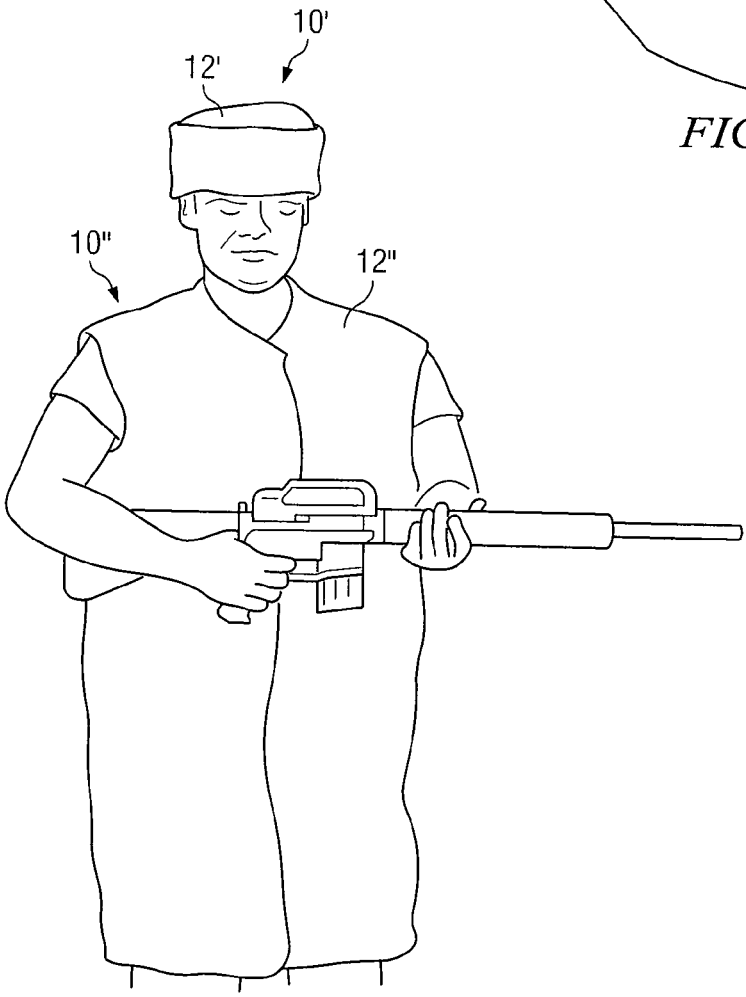
FIG. 3 is a perspective view of alternative multiple military training devices that may be worn by a trainee.

FIG. 3 is a perspective view of a trainee wearing multiple military training devices 10. A particular military training device 10' is configured in a piece of apparel 12' commonly referred to a kufi and another military training device 10" is configured in a piece of apparel 12" that is referred to as a burka. In this particular embodiment, head covering 12' is a kufi; however, may be any suitable type head covering, such as a cap, hat, scarf. Light transducing elements 16 configured on head covering 12' may provide unobstructed transmission, or reception of multiple integrated laser engagement system compliant signals.

In the embodiments shown, apparel 12' or 12" comprise civilian apparel. Civilian apparel refers to any apparel that worn by a human that is not indicative of military apparel. Integration of civilian apparel with the multiple integrated laser engagement system 14 may train military trainees to recognize a potential enemy combatant who may be disguised as a civilian in some embodiments. In another embodiment, apparel 12 is a military apparel. One example of military apparel may be, for example, a military uniform worn by an enemy. Use of military apparel with the multiple integrated laser engagement system may train trainees to identify enemy combatants based upon visual features of the enemy uniform.

Figure 4:
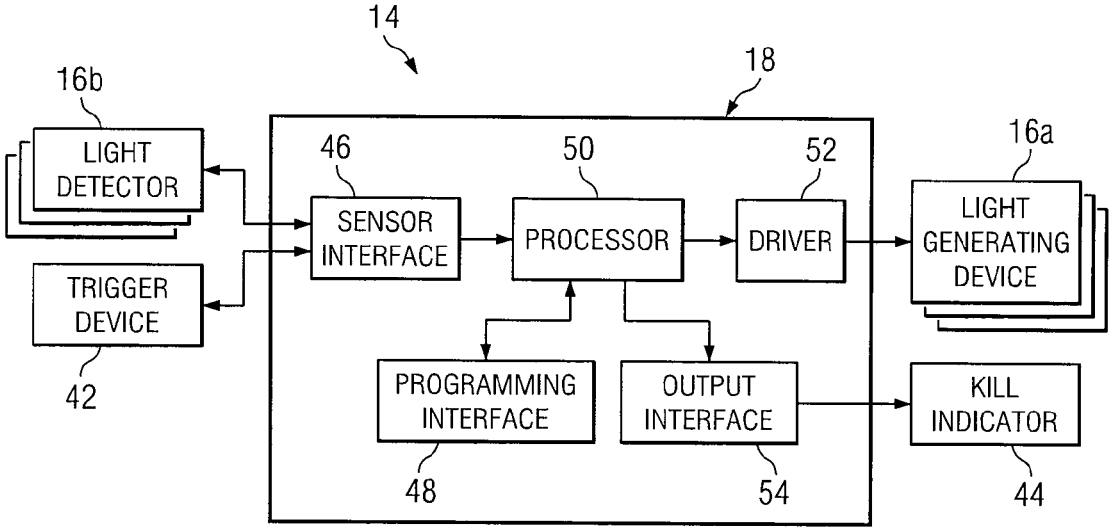
FIG. 4 is a diagram of one embodiment of a multiple integrated laser engagement system that may be used with the military training device of FIG. 1.

FIG. 4 is a block diagram of one embodiment of a multiple integrated laser engagement system 14 that may be incorporated with apparel 12. The multiple integrated laser engagement system 14 generally includes electrical circuit 18, one or more light detectors 16*b*, a trigger device 42, one or more light generating devices 16*a*, and a kill indicator 44. In this particular embodiment, multiple integrated laser engagement system 14 includes light detectors 16*b* for receiving multiple integrated laser engagement system compliant signals and light generating elements 16*a* for transmitting multiple integrated laser engagement system compliant signals. In other embodiments, multiple integrated laser engagement system may exclusively have either light detectors 16*b* or light generating devices 16*a*.

Trigger device 42 may be used to actuate a simulated weapon attack by signaling electrical circuit 18 to transmit a multiple integrated laser engagement system compliant signal to light generating device 16*a*. Trigger device 42 may be any suitable device, such as a momentary switch, that instructs electrical circuit 18 to transmit a multiple integrated laser engagement system compliant signal from light generating devices 16*a*.

Kill indicator 44 provides a visual and/or audible indication of a hit from another multiple integrated laser engagement system device transmitting multiple integrated laser engagement system compliant signals to the military training device 10. That is, upon receipt of a valid multiple integrated laser engagement system compliant signal by light detectors 16*b*, electrical circuit 18 transmits a kill signal or a near kill signal to kill indicator 44 informing the trainee of a hit or kill using kill indicator 44.

Electrical circuit 18 includes a sensor interface 26, a programming interface 48, a processor 50, a light generating device driver 52, and an output interface 54 coupled as shown. Processor 50 may be any type of computer processor that executes instructions stored in a memory. Sensor interface 46 receives signals from light detectors 16*b* and trigger device 42 and conditions these signals for use by processor 50. Programming interface 48 may be coupled to a remote computing system (not shown) for adding, removing, and/or modifying program instructions that are executed by processor 50. In one embodiment, programming interface 48 includes a universal serial bus (USB) port for communicating with the remote computing system. Driver 52 conditions signals received from processor 50 and forwards the conditioned signals to light generating elements 16*a*. Output interface 54 conditions signals from processor 28 for forwarding to kill indicator 44.

Electrical circuit 18 may be implemented with any suitable combination of hardware and/or software. The embodiment of electrical circuit 18 described above may be implemented on a printed circuit board that is approximately 1.0 inch by 1.0 inch in size and powered by a small battery pack.

Modifications, additions, or omissions may be made to multiple integrated laser engagement system 14 without departing from the scope of the disclosure. The components of multiple integrated laser engagement system 14 may be integrated or separated. For example, output interface 54 may not be needed if kill indicator 44 includes its own signal conditioning circuitry. Moreover, the operations of multiple integrated laser engagement system 14 may be performed by more, fewer, or other components. For example, programming interface 48 may use any suitable protocol, such as a recommended standard-232 (RS-232) protocol, for communication of processor 50 with another computing device. As used in this document, "each" refers to each member of a set or each member of a subset of a set.

Figure 5:
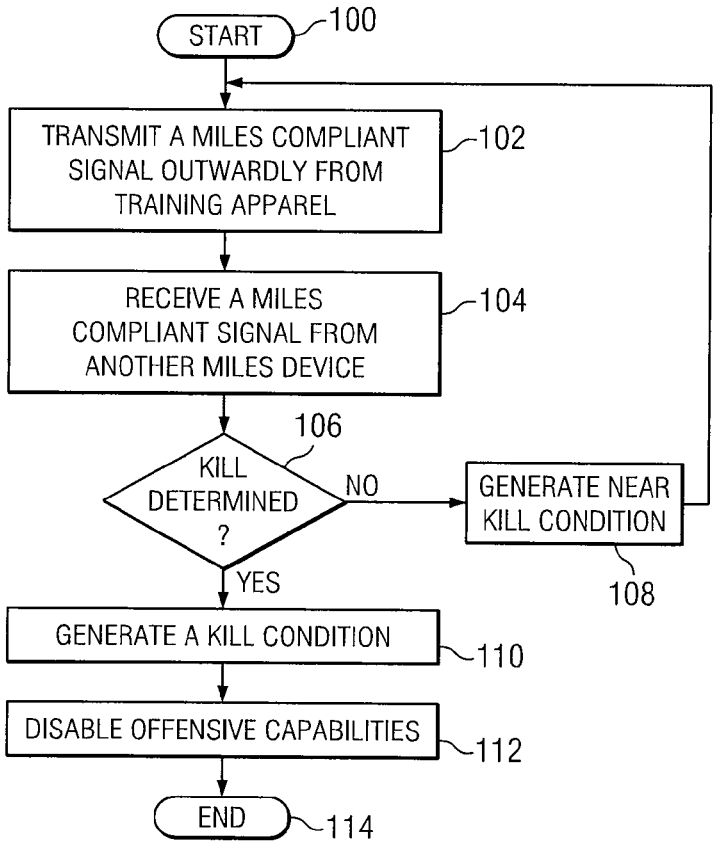
FIG. 5 is a flowchart showing a series of actions that may be performed by the military training device of FIG. 1.

FIG. 5 is a flowchart showing one embodiment of a series of actions that may be performed by the military training device 10. In act 100, the process is initiated. The process may be initiated by putting on the military training device 10 and participating in a military training maneuver.

In act 102, a multiple integrated laser engagement system compliant signal is transmitted by one or more light generating devices 16*a*. In one embodiment, multiple integrated laser engagement system compliant signal may have a signal strength and a radiation pattern that simulates a bomb blast.

In act 104, a multiple integrated laser engagement system compliant signal is received from another multiple integrated laser engagement system device. The multiple integrated laser engagement system device may be any device that simulates an offensive weapon, such as a bomb or a firearm. The multiple integrated laser engagement system compliant signal may be received by one or more of the light detectors 16*b* configured on apparel 12. Once received, light detectors 16*b* convert the received light energy into an electrical signal for transmission to electrical circuit 18.

In act 106, electrical circuit 18 determines a probability of a kill. Electrical circuit 18 may determine the probability of a kill according to a received signal strength, quantity of received near kill signals, and/or a random probability.

If electrical circuit 18 determines a near kill condition, processing continues in act 108 in which a near kill indication is generated. The electrical circuit 18 may then transmit the near kill indication to kill indicator 44 and resumes processing at act 102.

If electrical circuit 18, however, determines a kill indication, processing continues at act 110 in which a kill indication is generated. The kill indication is transmitted to kill indicator 44 to inform the trainee of the kill condition.

In act 112, electrical circuit 18 disables offensive capabilities of military training device 10. In the particular embodiment described above in which multiple integrated laser engagement system 14 includes light generating devices 16*a* as well as light detectors 16*b*, light generating devices 16*a* may be inhibited from further operation until the current military training maneuver is completed. In this manner, a particular trainee simulating a suicide bomber may be disabled from inflicting damage to other trainees.

Actions 102 through 112 may be continually repeated during use of military training device 10. When use of military training device 10 is no longer needed or desired, the process ends in act 114.

Modifications, additions, or omissions may be made to the method without departing from the scope of the disclosure. The method may include more, fewer, or other steps. For example, the method described above uses a multiple integrated laser engagement system device 14 that has offensive and defensive capabilities. Other military training devices 10, however, may have only offensive capabilities in which only light generating devices 16*a* are used, or only defensive capabilities in which only light detectors 16*b* are used.

Although the present disclosure has been described with several embodiments, a myriad of changes, variations, alterations, transformations, and modifications may be suggested to one skilled in the art, and it is intended that the present disclosure encompass such changes, variations, alterations, transformation, and modifications as they fall within the scope of the appended claims.

What is claimed is:

1. A military training device comprising:

a piece of civilian apparel; and a multiple integrated laser engagement system (MILES) device comprising:

a light generating device attached to an outer surface of the piece of civilian apparel and oriented so that a radiation pattern generated by the light generating device is directed outwardly from the piece of civilian apparel, the light generating device operable to transmit the multiple integrated laser engagement system compliant signal with a luminous intensity and a radiation pattern that simulates a bomb blast of an actual bomb;

a light detector operable to receive another multiple integrated laser engagement system compliant signal, and an electrical circuit embedded in the piece of civilian apparel, the electrical circuit being hidden from view when the piece of civilian apparel is worn.

2. A military training device comprising:

a piece of apparel; and a multiple integrated laser engagement system (MILES) device comprising a light transducing element that is operable to transmit or receive a multiple integrated laser engagement system compliant signal, the light transducing element attached to an outer surface of the piece of apparel and oriented so that a radiation pattern generated by the light transducing element is directed outwardly from the piece of apparel in a pattern that simulates a bomb blast of an actual bomb.

3. The military training device of claim 2, wherein the multiple integrated laser engagement system device comprises an electrical circuit that is embedded in the piece of apparel such that the electrical circuit is hidden from view when the piece of apparel is worn.

4. The military training device of claim 2, wherein the light transducing element is entrapped in the piece of apparel using one or more stitching seams.

5. The military training device of claim 2, wherein the light transducing element is attached to the piece of apparel using an adhesive.

6. The military training device of claim 2, wherein the light transducing element is operable to transmit the multiple integrated laser engagement system compliant signal with a luminous intensity and a radiation pattern that simulates a bomb blast of an actual bomb.

7. The military training device of claim 2, wherein the light transducing element is a light generating device selected from the group consisting of a light emitting diode and a laser.

8. The military training device of claim 2, wherein the piece of apparel comprises a piece of civilian apparel.

9. The military training device of claim 8, wherein the piece of civilian apparel comprises a head covering.

10. The military training device of claim 8, wherein the piece of civilian apparel comprises a burka.

11. The military training device of claim 2, wherein the piece of apparel comprises a piece of military apparel.

12. The military training device of claim 2, wherein the light transducing element is a light detector.

13. The military training device of claim 2, wherein the multiple integrated laser engagement system device is operable to transmit and receive a multiple integrated laser engagement system compliant signal.

14. A method comprising:

providing a piece of apparel and a multiple integrated laser engagement system (MILES) device comprising a light transducing element, the light transducing element attached to an outer surface of the piece of apparel and oriented so that a radiation pattern generated by the light transducing element is directed outwardly from the piece of apparel in a pattern that simulates a bomb blast of an actual bomb; and receiving or transmitting a multiple integrated laser engagement system compliant signal from another multiple integrated laser engagement system device.

15. The method of claim 14, wherein providing the multiple integrated laser engagement system device further comprises providing the multiple integrated laser engagement system device comprising an electrical circuit that is embedded in the piece of apparel such that the electrical circuit is hidden from view when the piece of apparel is worn.

16. The method of claim 14, further comprising generating a near kill condition due to receipt of the multiple integrated laser engagement system compliant signal.

17. The method of claim 14, further comprising generating a kill condition due to receipt of the multiple integrated laser engagement system compliant signal.

18. The method of claim 14, further comprising disabling transmission of another multiple integrated laser engagement system compliant signal if the kill condition is generated.

19. The method of claim 14, wherein providing the piece of apparel further comprises providing a piece of civilian apparel.

20. The method of claim 14, wherein receiving or transmitting the multiple integrated laser engagement system compliant signal further comprises transmitting and receiving multiple integrated laser engagement system compliant signals.

* * * * *